US010438760B2

(12) United States Patent
Uchida

(10) Patent No.: US 10,438,760 B2
(45) Date of Patent: Oct. 8, 2019

(54) SWITCH STRUCTURE

(71) Applicant: Olympus Corporation, Hachioji-shi, Tokyo (JP)

(72) Inventor: Junichi Uchida, Sagamihara (JP)

(73) Assignee: Olympus Corporation, Tokyo (JP)

( * ) Notice: Subject to any disclaimer, the term of this patent is extended or adjusted under 35 U.S.C. 154(b) by 0 days.

(21) Appl. No.: 15/967,542

(22) Filed: Apr. 30, 2018

(65) Prior Publication Data

US 2018/0337008 A1 Nov. 22, 2018

(30) Foreign Application Priority Data

May 16, 2017 (JP) ..... 2017-097555

(51) Int. Cl.

| | |
|---|---|
| ***H01H 13/14*** | (2006.01) |
| ***H01H 13/20*** | (2006.01) |
| ***H01H 3/12*** | (2006.01) |
| ***H01H 13/702*** | (2006.01) |
| ***H01H 13/704*** | (2006.01) |
| *H01H 3/60* | (2006.01) |
| *H01H 13/85* | (2006.01) |

(52) U.S. Cl.

CPC ..... *H01H 13/14* (2013.01); *H01H 3/12* (2013.01); *H01H 13/20* (2013.01); *H01H 13/702* (2013.01); *H01H 13/704* (2013.01); *H01H 3/60* (2013.01); *H01H 13/85* (2013.01); *H01H 2215/004* (2013.01); *H01H 2221/05* (2013.01); *H01H 2221/062* (2013.01)

(58) Field of Classification Search

CPC ..... H01H 13/20; H01H 2221/062; H01H 2227/022; H01H 2215/004; H01H 2215/014; H01H 2227/02; H01H 2221/064; H01H 2217/02

See application file for complete search history.

(56) References Cited

U.S. PATENT DOCUMENTS

| | | | | |
|---|---|---|---|---|
| 5,772,010 | A * | 6/1998 | Watanabe | H01H 13/20 200/342 |
| 6,765,164 | B2 * | 7/2004 | Lee | H01H 13/52 200/341 |
| 6,784,382 | B2 * | 8/2004 | Yanai | H01H 13/44 200/1 B |
| 7,564,002 | B2 * | 7/2009 | Watanabe | G03G 15/5016 200/341 |
| 7,598,466 | B2 * | 10/2009 | Tateda | H01H 13/704 200/341 |

(Continued)

FOREIGN PATENT DOCUMENTS

JP 04-363821 12/1992

*Primary Examiner* — Felix O Figueroa

(74) *Attorney, Agent, or Firm* — John C. Pokotylo; Pokotylo Patent Services

(57) ABSTRACT

A switch structure includes: a switch member that is deformed and receives a switch input, when force of a predetermined magnitude is applied thereto; a pressing member that presses the switch member; and an intermediate member that includes a first layer and a second layer, is interposed between the switch member and the pressing member, and is plate-like, the first layer being made of a synthetic resin and abutting against the switch member, the second layer being layered on the pressing member side of the first layer and being made of a material having a rigidity higher than the synthetic resin.

4 Claims, 5 Drawing Sheets

(56) References Cited

U.S. PATENT DOCUMENTS

| | | | | |
|---|---|---|---|---|
| 8,519,288 | B2 * | 8/2013 | Dai | H05K 5/0017 200/329 |
| 9,184,001 | B2 * | 11/2015 | Lin | H01H 13/02 |
| 9,364,749 | B2 * | 6/2016 | Yamagishi | A63F 13/06 |
| 9,449,770 | B2 * | 9/2016 | Sanford | H01H 13/705 |
| 2012/0222947 | A1 * | 9/2012 | Chang | H01H 13/83 200/517 |
| 2013/0087443 | A1 * | 4/2013 | Kikuchi | H01H 13/48 200/520 |
| 2018/0005777 | A1 * | 1/2018 | Yashima | H01H 13/14 |
| 2018/0283669 | A1 * | 10/2018 | Lin | H01H 13/023 |

* cited by examiner

SWITCH STRUCTURE

CROSS-REFERENCE TO RELATED APPLICATIONS

This application is based upon and claims the benefit of priority from Japanese Patent Application No. 2017-097555, filed on May 16, 2017, the entire contents of which are incorporated herein by reference.

BACKGROUND

The present disclosure relates to a switch structure. As disclosed in Japanese Patent Application Laid-open No. H04-363821, a switch structure including a dome-shaped click metal has been known as a switch structure that enables a user to feel click feeling when the user makes an input through a switch. By having a sheet formed of sheet-like synthetic resin and conductor layered over each other interposed between a push button and a click metal, this switch structure prevents inversion sound (click noise) of the click metal from leaking outside a casing thereof.

SUMMARY

A switch structure according to one aspect of the present disclosure includes: a switch member that is deformed and receives a switch input, when force of a predetermined magnitude is applied thereto; a pressing member that presses the switch member; and an intermediate member that includes a first layer and a second layer, is interposed between the switch member and the pressing member, and is plate-like, the first layer being made of a synthetic resin and abutting against the switch member, the second layer being layered on the pressing member side of the first layer and being made of a material having a rigidity higher than the synthetic resin.

The above and other features, advantages and technical and industrial significance of this disclosure will be better understood by reading the following detailed description of presently preferred embodiments of the disclosure, when considered in connection with the accompanying drawings.

DETAILED DESCRIPTION

Hereinafter, by reference to the appended drawings, embodiments will be described. The drawings are just schematic drawings.

First Embodiment

Figure 1:
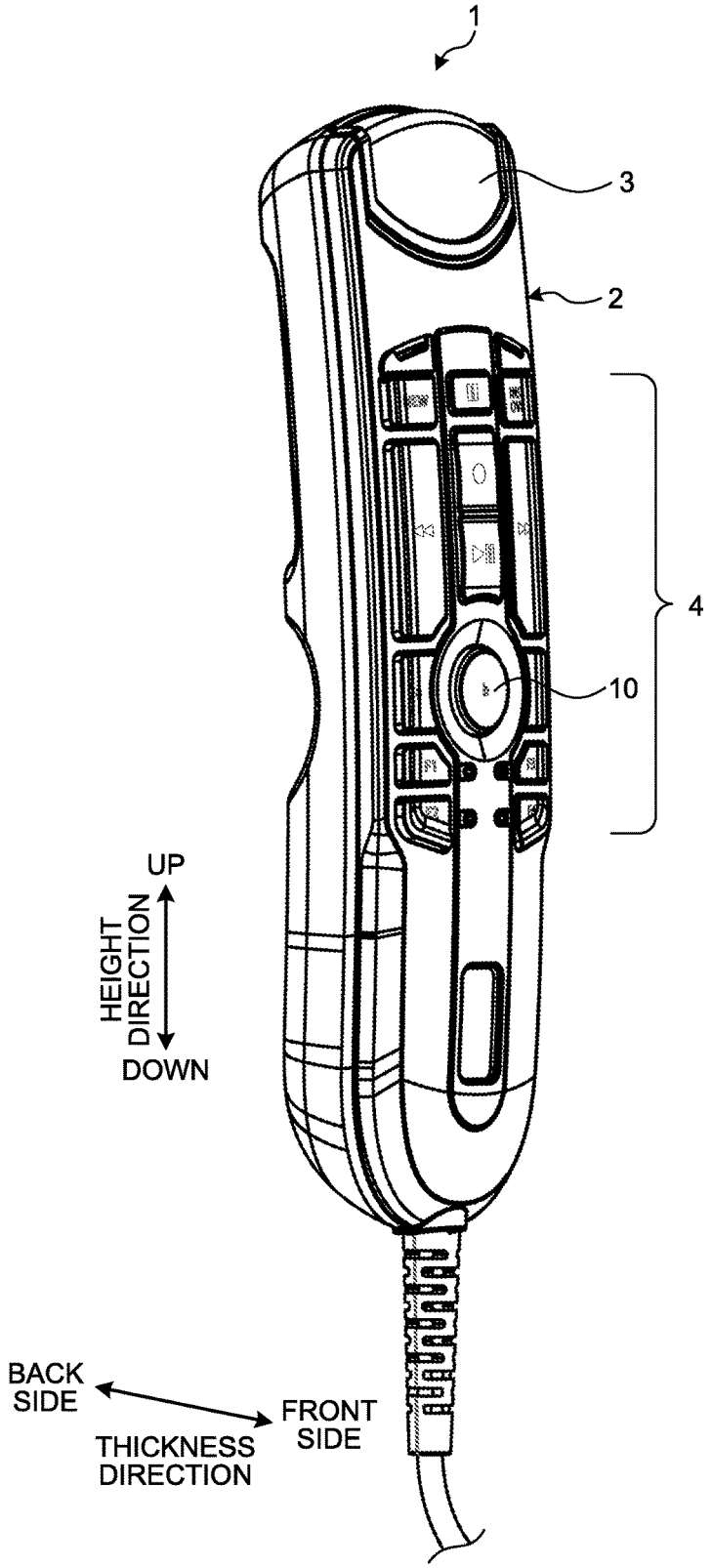
FIG. 1 is a perspective view illustrating an exterior configuration of a sound information acquisition device having a switch structure according to a first embodiment.

FIG. 1 is a perspective view illustrating a front side configuration of a sound information acquisition device, which is an example of a device having a switch structure according to a first embodiment. A sound information acquisition device 1 illustrated in FIG. 1 is a device that acquires sound information by collecting sound generated outside the device. The sound information acquisition device 1 includes a casing 2, a sound collecting unit 3, and an operating unit 4.

The casing 2 accommodates therein various electronic parts for implementation of functions of the sound information acquisition device 1. The casing 2 is approximately cuboidal, and forms a shape that extends vertically long in a state of being held by a hand of a user. The casing 2 has a size allowing approximately a half of the casing 2 in a height direction (an up-down direction in FIG. 1) thereof to be fitted in the palm of a hand of the user in the state of being held by the hand of the user. Further, the casing 2 has a thickness allowing the user to hold the casing 2 with the user's index finger to little finger being placed around a back surface of the casing 2 in a state where the user has placed the thumb on a front surface of the casing 2.

The sound collecting unit 3 is provided at a height direction upper end portion of the casing 2, and has a function of collecting sound. The sound collecting unit 3 includes: a filter that removes various noises including a noise included in the sound; and a microphone that is accommodated inside the casing 2, and collects the sound propagated via the filter.

The operating unit 4 has plural operation buttons, each of which is provided on a front side of the casing 2. The operation buttons are push buttons that are pushed in toward the inside of the casing 2 by being pressed by the user with a finger. The plural operation buttons include, for example, a button for start or ending of recording, or for playback. Hereinafter, by use of an operation button 10 provided in a central portion of the casing 2 on the front side, a configuration of the switch structure according to the first embodiment will be described in detail.

Figure 2:
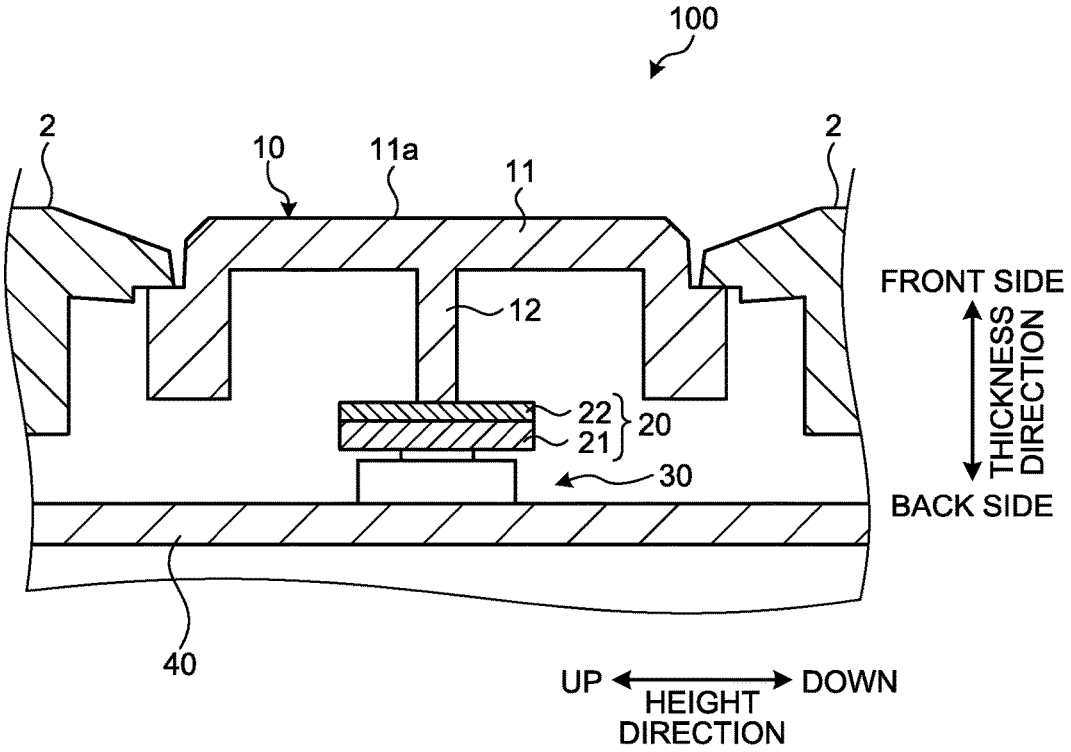
FIG. 2 is partial sectional view illustrating a configuration of the switch structure according to the first embodiment.
Figure 3:
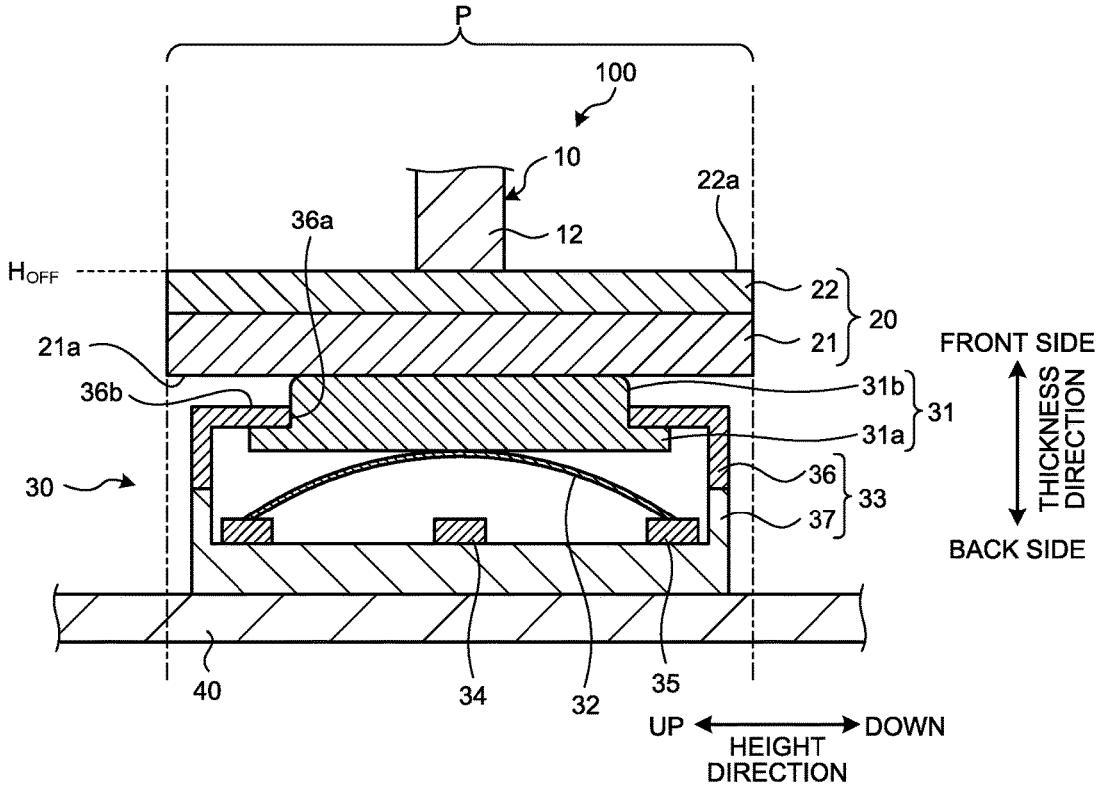
FIG. 3 is sectional view illustrating a configuration of main parts of the switch structure according to the first embodiment.

FIG. 2 is a partial sectional view illustrating the configuration of the switch structure according to the first embodiment. FIG. 3 is sectional view illustrating a configuration of main parts of the switch structure according to the first embodiment. FIG. 2 and FIG. 3 are sectional views viewed as sections passing the center of the operation button 10 and parallel to the height direction and a thickness direction illustrated in FIG. 1. A switch structure 100 illustrated in FIG. 2 and FIG. 3 includes the operation button 10, an intermediate member 20, a switch member 30, and an electric board 40.

The operation button 10 is a pressing member that presses the switch member 30 via the intermediate member 20. The operation button 10 has: a main body portion 11, which has a front side facing outside and forming a bottom portion, and a side facing inside and being open, and which is approximately cylindrical; and a protruding portion 12, which protrudes toward the intermediate member 20 from the bottom portion of the main body portion 11, and which forms a flat plate-like shape. By causing a finger to come into contact with an outer surface 11*a* of the main body portion 11, the user of the sound information acquisition device 1 applies pressing force to the operation button 10. The operation button 10 is formed by use of, for example, a synthetic resin.

The intermediate member 20 is a plate-like member, which has a first layer 21 that abuts against the switch member 30, and a second layer 22 that is layered on the operation button 10 side of the first layer 21, and which is interposed between the switch member 30 and the operation button 10. The plate-like shape referred to herein may be a flat plate-like shape, or a shape close to a flat plate-like shape, like a shape that is a little curved, or a wavy shape having repetition of slight concavity and convexity. The first layer 21 and the second layer 22 are integrated with each other by bonding. This bonding may be implemented by use of, for example, a double sided tape, or an adhesive.

The first layer 21 is formed by use of, for example, an elastomer, such as rubber, or a soft synthetic resin, such as an urethane resin. A surface 21*a*, which is a surface of the first layer 21 and a side facing the switch member 30, abuts against a distal end surface of a convex portion 31*b* of the switch member 30. An area of the surface 21*a* is equal to or larger than an area of the distal end surface of the convex portion 31*b*.

A surface 22*a* of the second layer 22 on the operation button 10 side is bonded to a distal end surface of the protruding portion 12 of the operation button 10. This bonding is also implemented by use of, for example, a double sided tape, or an adhesive. An area of the surface 22*a* is equal to or larger than the area of the surface 21*a* of the first layer 21. The second layer 22 is formed by use of a material having a rigidity higher than that of the synthetic resin forming the first layer 21. Specifically, the second layer 22 is formed by use of a hard synthetic resin, such as, for example: an engineering plastic, like a polyamide, a polycarbonate, or polyethylene terephthalate; or a super engineering plastic, such as a polyimide. A hardness and a thickness of the second layer 22 are set such that the second layer 22 is not warped even if the second layer 22 receives force of a predetermined magnitude from the operation button 10. The second layer 22 may be formed by use of a metal or an alloy.

When force of a predetermined magnitude (pressing force) is applied to the switch member 30, the switch member 30 is deformed and receives a switch input. The switch member 30 has: a plunger 31 that is a member to be pressed; a contact plate 32 that is an elastic body having conductivity; a first contact member 34; and a second contact member 35. The switch member 30 is a switch called a TACT switch (registered trademark) or a tactile switch, and has a structure enabling the user to feel click feeling when a switch input is made.

The plunger 31 has: a proximal portion 31*a* that is accommodated inside a housing 33, and abuts against the contact plate 32 inside the housing 33; and the convex portion 31*b* that is formed on a front side of the proximal portion 31*a*, and protrudes from the housing 33 and abuts against the surface 21*a* of the first layer 21 of the intermediate member 20. When a force equal to or larger than a predetermined magnitude toward a back side (the contact plate 32 side) in the thickness direction acts on the plunger 31, the plunger 31 moves toward the back side, that is, toward the first contact member 34, while deforming the contact plate 32.

The contact plate 32 is a member that is convexly curved toward the plunger 31 and that forms an approximately semispherically shell-like dome shape, and a top portion of a dome thereof abuts against a bottom surface of the proximal portion 31*a* of the plunger 31, in a state illustrated in FIG. 3, that is, in an initial state where the operation button 10 has not been operated. The contact plate 32 is formed by use of, for example, a conductive material, such as a metal or an alloy. When a force equal to or larger than a predetermined magnitude toward the back side in the thickness direction continues to be applied to the contact plate 32 from the plunger 31, the contact plate 32 is deformed by the pressing such that the dome is crushed, and eventually, a protruding direction around the top portion of the dome is inverted and the contact plate 32 buckles.

The housing 33 is a casing that accommodates therein the proximal portion 31*a* of the plunger 31, the contact plate 32, the first contact member 34, and the second contact member 35. The housing 33 is formed of a combination of a cover portion 36 that is positioned at a front side, and a pedestal portion 37 that is positioned at a back side. At a front side of the cover portion 36, an opening portion 36*a*, through which the convex portion 31*b* of the plunger 31 is able to protrude, is formed. An upper surface 36*b* of the cover portion 36 at the front side is a flat surface, against which the surface 21*a* of the first layer 21 of the intermediate member 20 is abuttable. A bottom portion of the pedestal portion 37 is mounted on the electric board 40. The housing 33 is preferably positioned, as illustrated in FIG. 3, in a pillar-shaped region P passing an outer edge of the intermediate member 20 and extending in a direction perpendicular to the electric board 40.

The first contact member 34 is positioned at a back side of a top position of the contact plate 32 in the thickness direction. The first contact member 34 comes into contact with the top portion of the inverted dome of the contact plate 32 that has buckled.

An end portion of an opening of the contact plate 32 (supporting end portion) is attached to the second contact member 35. When the contact plate 32 buckles and contacts the first contact member 34, the first contact member 34 and the second contact member 35 electrically connect with each other via the contact plate 32. Thereby, the switch member 30 receives a switch input.

Figure 4:
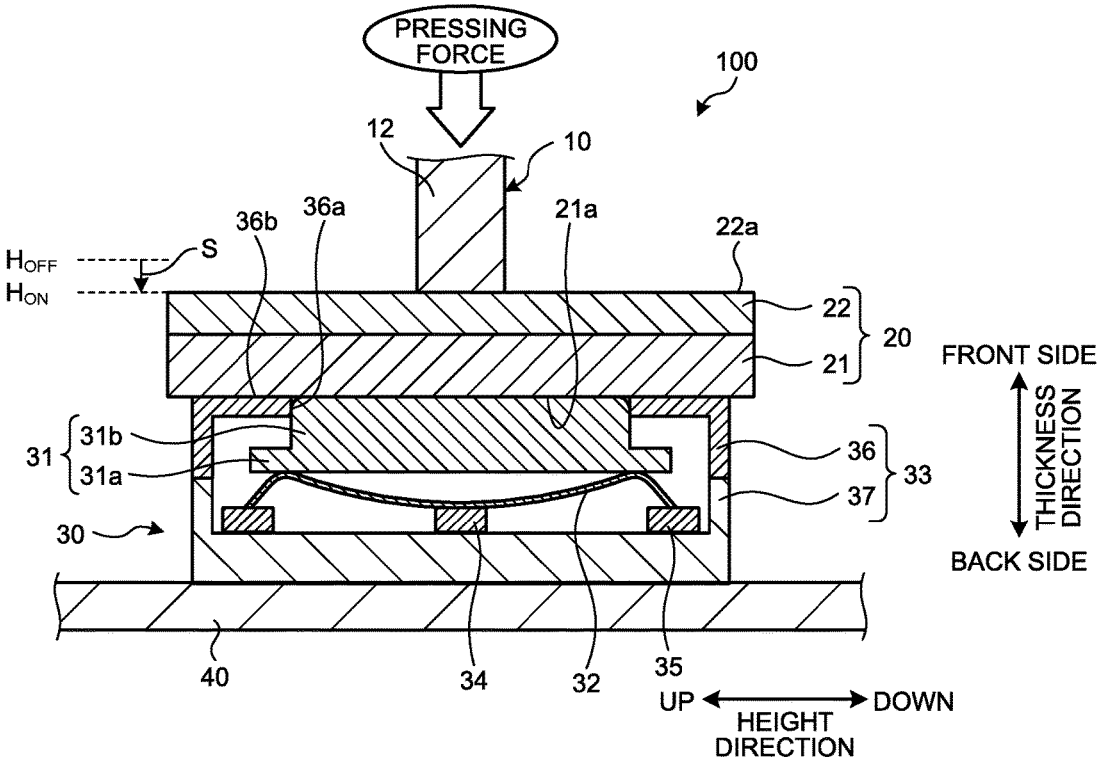
FIG. 4 is a sectional view illustrating a state where a contact plate of the switch structure according to the first embodiment buckles and a switch member receives a switch input.

FIG. 4 is a sectional view illustrating a state where the contact plate 32 of the switch structure 100 having the above described configuration buckles and the switch member 30 receives a switch input. In FIG. 4, a curving direction of the top portion of the dome of the contact plate 32 has been inverted and the top portion is in contact with the first contact member 34, and the first contact member 34 and the second contact member 35 are electrically connected with each other. A front side position of the intermediate member 20 in the thickness direction has been displaced to a position HON that is lower than a position $H_{OFF}$ in the initial state illustrated in FIG. 3 by a stroke amount S, and the surface 21*a* is in surface contact with the upper surface 36*b* of the cover portion 36. In this state, a distal end surface of the convex portion 31*b* of the plunger 31 has retracted to the same position as the upper surface 36*b* of the cover portion 36 in the thickness direction.

In the state illustrated in FIG. 4, the intermediate member 20 is hardly changed in shape by the pressing of the operation button 10, and the surface contact is achieved such that the first layer 21 covers the cover portion 36 of the housing 33 and the convex portion 31*b* from a front side to a back side in the thickness direction. Therefore, by the first layer 21 absorbing vibration, which is generated when the contact plate 32 buckles, and which is transmitted to the housing 33; click noise is able to be reduced properly, the first layer 21 being formed of a soft synthetic resin.

Depending on the rigidity of the first layer 21, while the surface 21*a* of the first layer 21 comes into surface contact with the upper surface 36*b* of the cover portion 36 in the state where the contact plate 32 has buckled, the distal end surface of the convex portion 31*b* may be in a state of having entered the first layer 21 by deforming the first layer 21 without retracting to the same position as the upper surface 36*b* in the thickness direction. In this case also, since the surface 21*a* of the first layer 21 is in surface contact with the upper surface 36*b* and the distal end surface of the convex portion 31*b*; by absorption of the vibration that has been transmitted to the housing 33 by the buckling of the contact plate 32 and shielding preventing the vibration from leaking outside, click noise is able to be reduced properly.

According to the above described first embodiment, since the intermediate member 20 is interposed between the operation button 10 and the switch member 30, the intermediate member 20 having the first layer 21 formed of a soft synthetic resin and the second layer 22 layered on the operation button 10 side of the first layer 21 and formed of a material having a rigidity higher than that of the synthetic resin forming the first layer 21; with a simple configuration, click noise is able to be reduced, by the first layer 21 absorbing the vibration generated in association with the deformation of the switch member 30 and the first layer 21 serving as a shield preventing the vibration from leaking outside.

Further, according to the first embodiment, since the soft first layer 21 comes into contact with the housing 33 when the contact plate 32 of the switch member 30 buckles, click noise is able to be reduced properly by: the first layer 21 absorbing the vibration generated when the contact plate 32 buckles and transmitted to the housing 33; and the first layer 21 serving as a shield preventing the vibration from leaking outside.

Comparison with the configuration disclosed in Japanese Patent Application Laid-open No. H04-363821 cited above will now be made. In the configuration disclosed in Japanese Patent Application Laid-open No. H04-363821, since vibration generated when the click metal buckles (is inverted) is transmitted to the soft sheet, even thought the synthetic resin has been laminated, secondary noise caused by the vibration may be generated. In contrast, in this first embodiment, since the intermediate member 20 has the hard second layer 22, the intermediate member 20 is difficult to be deformed, and the soft first layer 21 is able to absorb the vibration of the housing 33 infallibly. Therefore, a click noise reducing effect that is better than that of the configuration disclosed in the above cited Japanese Patent Application Laid-open No. H04-363821 is able to be achieved.

In the first embodiment, the surface 21*a* of the first layer 21 is not necessarily a plane, and may be a wavy corrugated surface. Further, a part of the surface 21*a* may be corrugated.

Further, in the first embodiment, the click noise reducing effect is able to be achieved as long as the first layer 21 is configured to contact the distal end surface of the convex portion 31*b* and to contact at least a part of a surface of the cover portion 36 so as to cover the part from the front side to the back side in the thickness direction in a state where the contact plate 32 has buckled.

Second Embodiment

Next, a second embodiment will be described. Differently from the above described first embodiment, in a switch structure according to the second embodiment, a first layer of an intermediate member abuts against a contact plate. Hereinafter, description of any configuration that is that same as that of the above described first embodiment will be omitted, and the same reference sign will be used therefor.

Figure 5:
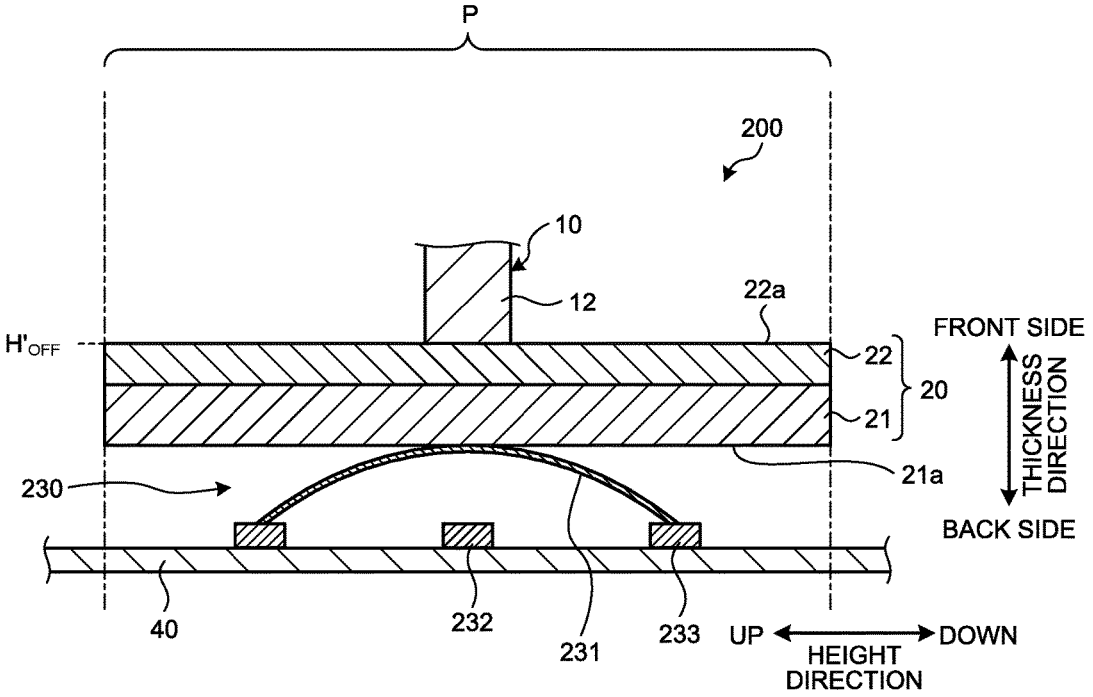
FIG. 5 is sectional view illustrating a configuration of main parts of a switch structure according to a second embodiment.

FIG. 5 is a sectional view illustrating a configuration of main parts of the switch structure according to the second embodiment. A switch structure 200 illustrated in FIG. 5 includes the operation button (pressing member) 10, the intermediate member 20, a switch member 230, and the electric board 40.

The switch member 230 has: a contact plate (member to be pressed) 231, which is an elastic body having conductivity; a first contact member 232; and a second contact member 233. The first contact member 232 and the second contact member 233 are mounted on the electric board 40.

The contact plate 231 is a member forming a dome shape that is convexly curved toward the intermediate member 20, and the contact plate 231 abuts against the surface 21*a* of the first layer 21 of the intermediate member 20 at a top portion of a dome thereof, in an initial state illustrated in FIG. 5. This abutment is not essential, and the intermediate member 20 and the contact plate 231 may be close to each other with a slight gap therebetween.

The first contact member 232 is positioned at a back side of a top position of the contact plate 231 in a thickness direction. The first contact member 232 contacts the top portion of the inverted dome of the contact plate 231 when the contact plate 231 buckles.

An end portion of an opening of the contact plate 231 (supporting end portion) is attached to the second contact member 233. When the contact plate 231 buckles and contacts the first contact member 232, the first contact member 232 and the second contact member 233 electrically connect with each other via the contact plate 231. Thereby, the switch member 230 receives a switch input.

When a user performs a switch input operation on the switch member 230 having the above described configuration, by buckling of the contact plate 231, the user is able to feel click feeling.

In the switch member 230, the contact plate 231, the first contact member 232, and the second contact member 233 are preferably positioned in the pillar-shaped region P passing through the outer edge of the intermediate member 20 and extending in a direction perpendicular to the electric board 40, as illustrated in FIG. 5.

Figure 6:
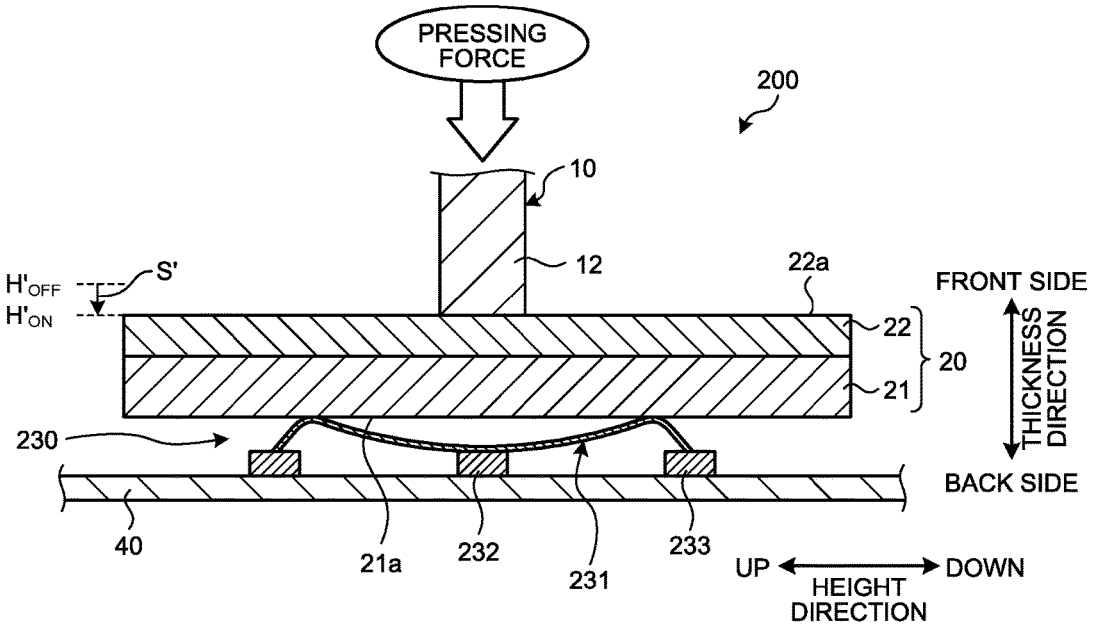
FIG. 6 is a sectional view illustrating a state where a contact plate of the switch structure according to the second embodiment buckles and a switch member receives a switch input.

FIG. 6 is a sectional view schematically illustrating a state where the contact plate 231 of the switch structure 200 has buckled and the switch member 230 has received a switch input. In FIG. 6, a curving direction of the top portion of the dome of the contact plate 231 has been inverted and the top portion is in contact with the first contact member 232, and the first contact member 232 and the second contact member 233 have electrically connected with each other via the contact plate 231. A front side position of the intermediate member 20 in the thickness direction has been displaced to a position H'ON that is lower than a position $H'_{OFF}$ in the initial state illustrated in FIG. 5 by a stroke amount S', and the surface 21*a* is in contact with the contact plate 231 so as to cover the contact plate 231. A contacting portion with the contact plate 231 in this state is an approximately annular portion at an outer peripheral side of the top portion of the dome of the contact plate 231.

In the state illustrated in FIG. 6, the intermediate member 20 contacts the contact plate 231 such that the first layer 21 covers the switch member 230, without practically being changed in shape by the pressing of the operation button 10.

Therefore, by the first layer 21 absorbing vibration that is generated when the contact plate 231 buckles, the first layer 21 being formed of a soft synthetic resin, and the first layer 21 serving as a shield preventing the vibration from leaking outside; click noise is able to be reduced properly.

According to the above described second embodiment, since the intermediate member 20 is interposed between the operation button 10 and the switch member 230, the intermediate member 20 having the first layer 21 formed of a soft synthetic resin and the second layer 22 layered on the operation button 10 side of the first layer 21 and formed of a material having a rigidity higher than that of the synthetic resin forming the first layer 21; with a simple configuration, click noise is able to be reduced, by the first layer 21 absorbing the vibration associated with the deformation of the switch member 230 and the first layer 21 serving as a shield preventing the vibration from leaking outside.

Further, according to the second embodiment, even if the contact plate 231 buckles, the contact with the first layer 21 is maintained, and thus the first layer 21 directly absorbs the vibration of the contact plate 231, and click noise is able to be reduced properly. Needless to say, similarly to the first embodiment, this switch structure 200 has a click noise reducing effect better than that of the configuration disclosed in the above cited Japanese Patent Application Laid-open No. H04-363821.

Figure 7:
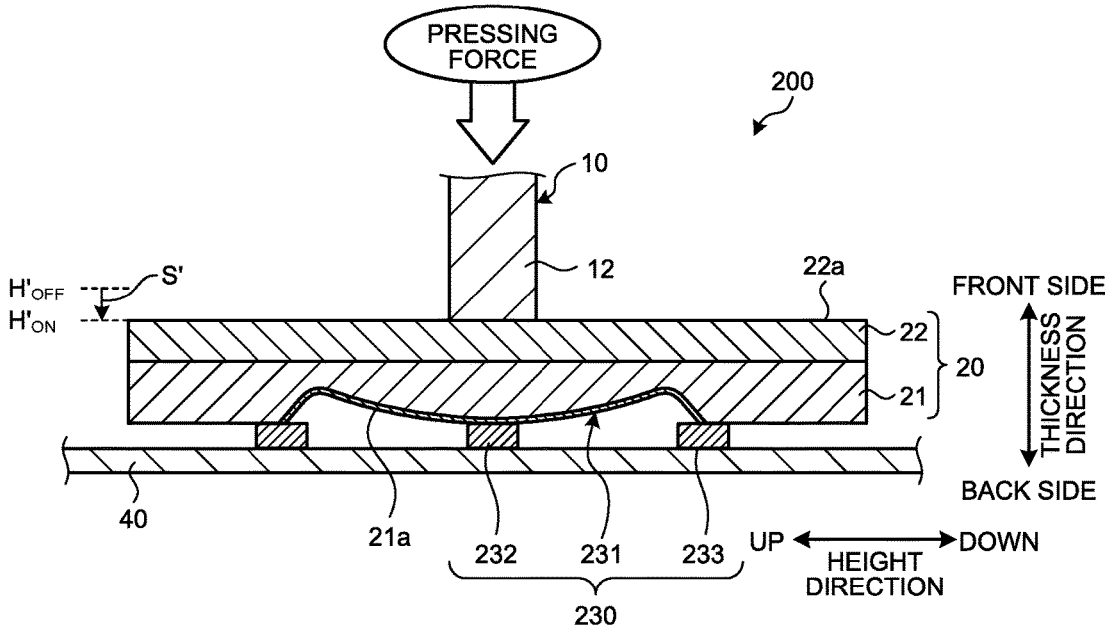
FIG. 7 is a sectional view illustrating a state where a contact plate of a switch structure according to a modified example of the second embodiment buckles and a switch member receives a switch input.

In the second embodiment, the click noise reducing effect is able to be achieved as long as the first layer 21 is configured to be deformed and come into contact with at least a part of a surface of the contact plate 231 so as to cover the part from a front side to a back side in the thickness direction in the state where the contact plate 231 has buckled. As illustrated in FIG. 7, when the first layer 21 is deformed so as to contact approximately the entire front side surface of the contact plate 231 and cover the contact plate 231, an even higher click noise reducing effect is able to be achieved.

Other Embodiments

The present disclosure should not be limited only to the above described first and second embodiments. For example, the intermediate member may have a multi-layer structure having three or more layers.

Further, the above described switch structure 100 or 200 is applicable to a device that acquires image information, such as a moving image, in addition to sound information, like a digital camera or a digital video camera.

The operation button is not necessarily an integrally molded part made of resin, and may be a pillar-shaped structural body that is made of metal or alloy. In that case, without the provision of the second layer 22 on the back surface of the operation button 10, the first layer 21 may be directly bonded to the back surface.

Additional advantages and modifications will readily occur to those skilled in the art. Therefore, the disclosure in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A switch structure, comprising:

a switch member that is deformed and receives a switch input, when force of a predetermined magnitude is applied thereto;

a pressing member that presses the switch member; and an intermediate member that includes a first layer and a second layer, is interposed between the switch member and the pressing member, and is plate-like, the first layer being made of a synthetic resin and abutting against the switch member, the second layer being layered on the pressing member side of the first layer and being made of a material having a rigidity higher than the synthetic resin, wherein at least a part of the switch member is covered by the first layer and contacts the intermediate member, when the force of the predetermined magnitude is applied to the switch member and the switch member is deformed, the part being on a side facing the first layer, wherein the switch member includes:

a plunger including a convex portion that abuts against the first layer and a proximal portion that is positioned at a proximal end of the convex portion, the plunger being movable in a pressing direction of the pressing member;

a contact plate that abuts against a bottom surface of the proximal portion, that has a dome shape, and that is deformed in association with movement of the plunger when the force of the predetermined magnitude is applied thereto; and a housing that accommodates therein the proximal portion and the contact plate, and wherein the first layer contacts the housing in a state where a curving direction of a top portion of the contact plate has been inverted and the contact plate has buckled.

2. The switch structure according to claim 1, wherein the synthetic resin is an elastomer or an urethane resin.

3. A switch structure, comprising:

a switch member that is deformed and receives a switch input, when force of a predetermined magnitude is applied thereto;

a pressing member that presses the switch member; and an intermediate member that includes a first layer and a second layer, is interposed between the switch member and the pressing member, and is plate-like, the first layer being made of a synthetic resin and abutting against the switch member, the second layer being layered on the pressing member side of the first layer and being made of a material having a rigidity higher than the synthetic resin, wherein the switch member includes:

a plunger including a convex portion that abuts against the first layer and a proximal portion that is positioned at a proximal end of the convex portion, the plunger being movable in a pressing direction of the pressing member;

a contact plate that abuts against a bottom surface of the proximal portion, that has a dome shape, and that is deformed in association with movement of the plunger when the force of the predetermined magnitude is applied thereto; and a housing that accommodates therein the proximal portion and the contact plate, and wherein the first layer contacts the housing in a state where a curving direction of a top portion of the contact plate has been inverted and the contact plate has buckled.

4. The switch structure according to claim 3, wherein the synthetic resin is an elastomer or an urethane resin.

* * * * *